United States Patent [19]

Goller et al.

[11] Patent Number: 4,711,101

[45] Date of Patent: Dec. 8, 1987

[54] FLAT-BED KNITTING MACHINE

[75] Inventors: Ernst Goller; Adam Müller; Udo Hermann, all of Reutlingen, Fed. Rep. of Germany

[73] Assignee: H. Stoll GmbH & Co., Fed. Rep. of Germany

[21] Appl. No.: 890,265

[22] Filed: Jul. 29, 1986

[30] Foreign Application Priority Data

Aug. 9, 1985 [DE] Fed. Rep. of Germany ..... 3528694

[51] Int. Cl.[4] ..... D04B 7/04

[52] U.S. Cl. ..... 66/64; 66/75.2

[58] Field of Search ..... 66/75.2, 64, 232

[56] References Cited

FOREIGN PATENT DOCUMENTS 60-88157 5/1985 Japan ..... 66/75.2

*Primary Examiner*—Ronald Feldbaum

*Attorney, Agent, or Firm*—Jones, Tullar & Cooper

[57] ABSTRACT

A flat-bed knitting machine having a needle bed apparatus and an associated carriage apparatus movable longitudinally thereon and having a data processing unit which controls the cams and/or selector units among others and store pattern information in memory and which has an input keyboard is described. To make the input keyboard accessible to the operator of such a machine during observation of the knitting process, yet not have this keyboard hinder access to the essential parts of the machine, the input keyboard is disposed, from the standpoint of the machine operator, at the level of and in an area in front of the needle bed and carriage apparatus in the longitudinal direction of the machine, in front of a transparent cover, which is also movable in the longitudinal direction of the machine, keyboard being movable parallel to and independently of this cover.

24 Claims, 6 Drawing Figures

FLAT-BED KNITTING MACHINE

FIELD OF THE INVENTION

The present invention relates to a flat-bed knitting machine with a needle bed and carriage apparatus movable along it and having a data processing unit, which controls the cams and/or selector units and stores pattern information in memory. The data processing unit has an input keyboard.

BACKGROUND OF THE INVENTION

In conventional known flat-bed knitting machines of this type (see Brochure DNVHG-F published in April, 1984 by the assignee of the present application, the data processing unit is a separate structural component, with the input keyboard built into its housing front, and is disposed underneath one of the ends of the needle bed apparatus, which protrudes beyond the machine frame, in the vicinity of which the knitted goods are taken off. Although this is a space-saving location of the data processing unit, it is, nevertheless, inconvenient and impractical for the knitting machine operator, for instance when the pattern data for the size of goods to be knitted or the like must be changed, because to accomplish this the operator has to bend down or work from a crouching position. Furthermore, the operator is unable to reach the keyboard while he is observing the knitting process.

OBJECT AND SUMMARY OF THE INVENTION

It is accordingly an object of the present invention to provide a flat-bed knitting machine of the above type such that the operator can reach the input keyboard while observing the knitting process, and the input keyboard nevertheless does not hinder access to the important components of the flat-bed knitting machine.

This object is attained by disposing the input keyboard at the level of the needle bed and carriage apparatus, in a region in front of them, and such that it is movable in the longitudinal direction of the knitting machine.

Because the input keyboard is retained in this arrangement, the machine operator is able to reach the keyboard in a simple manner even while observing the knitting process, and he is able to intervene if need be. The input keyboard does not prevent free access, in particular to the needle bed and carriage apparatus, because it can be moved to any arbitrary location in the longitudinal direction of the machine. At the same time, this means that the input keyboard is reachable by the operator at any time, regardless of the position along the machine where the operator is located.

According to an exemplary embodiment of the present invention, the input keyboard can suitably be secured on a transparent protective cover that is movable in the longitudinal direction of the machine, such that the keyboard can be pivoted upward. As a result, the keyboard is on the one hand movable along with the protective cover, and on the other it can be pivoted up out of the way to provide a clear view of the needle bed and carriage apparatus if necessary.

According to a preferred exemplary embodiment of the invention, however, the input keyboard is movable parallel to and in front of a transparent protective cover that is movable in the longitudinal direction of the machine, the keyboard movement being independent of the movement of the cover. This arrangement has particular advantages in terms of its independence of the protective cover, because the input keyboard can be moved at any time to any arbitrary position in the longitudinal direction of the machine, without losing the protection afforded by the protective cover against unintentionally reaching into the working area of the machine.

A simply-manufactured construction of a functionally suitable input keyboard is advantageously provided in an exemplary embodiment, by securing the keyboard to an at least partly platform-like element, the lower end of which is guided resting in a track of a lower profile section and the upper end of which is guided by suspension in a track of an upper profile section. An upper horizontal region is provided, which is either platform-like or embodied by two parallel hollow bars. In the first case, an intermediate bottom is disposed at least underneath the upper horizontal portion of the plate, and at least one control cable rests on this intermediate bottom, while in the second case the hollow bars are embodied such that at least one of them can receive at least one control cable.

To enable moving the input keyboard readily into any arbitrary position in the longitudinal direction of the machine, along with the control cable or cables leading to it, or in other words, without its being hindered by these cables, each control cable is connected to a spring-loaded device for the movement-guided reception of the control cable in every position of the input keyboard along the machine. This can be accomplished for example by a cable winder device disposed on one end. In one exemplary embodiment, however, the cable winder device is simply embodied by a guide recess and at least one cable deflection roller disposed longitudinally movably therein. In other words, via the cable deflection roller the control cable extends from its stationary connection end to the movable input keyboard, and the cable deflection roller, which is suitably secured to a carriage, is connected to a stationary spring winder, which tends to pull the cable deflection roller, or its carriage, toward it.

If the guide recess is embodied in the upper profile section, below the movement track for the upper free end of the input keyboard, then on the one hand a space-saving arrangement of this cable holder device is attained, and on the other hand the control cable or cables is disposed such that they are unhindered and can move.

In a particularly advantageous manner, the upper profile section is embodied for guiding the input keyboard through or on the associated long side of the spool table of the flat bed knitting machine, while the lower profile section is embodied by a profile rail secured to the machine frame underneath the needle bed apparatus, so that once again a space-saving construction which does not hinder access to the needle bed and carrriage apparatus is attained.

The input keyboard is suitably provided not only with the individual keys, but also with a display panel and/or a recess or holder for documents at the same time.

Further details and embodiments of the invention will become apparent from the ensuing detailed description of the exemplary embodiment of the invention shown in the drawings.

DESCRIPTION OF THE PREFERRED EMBODIMENT

Figure 1:
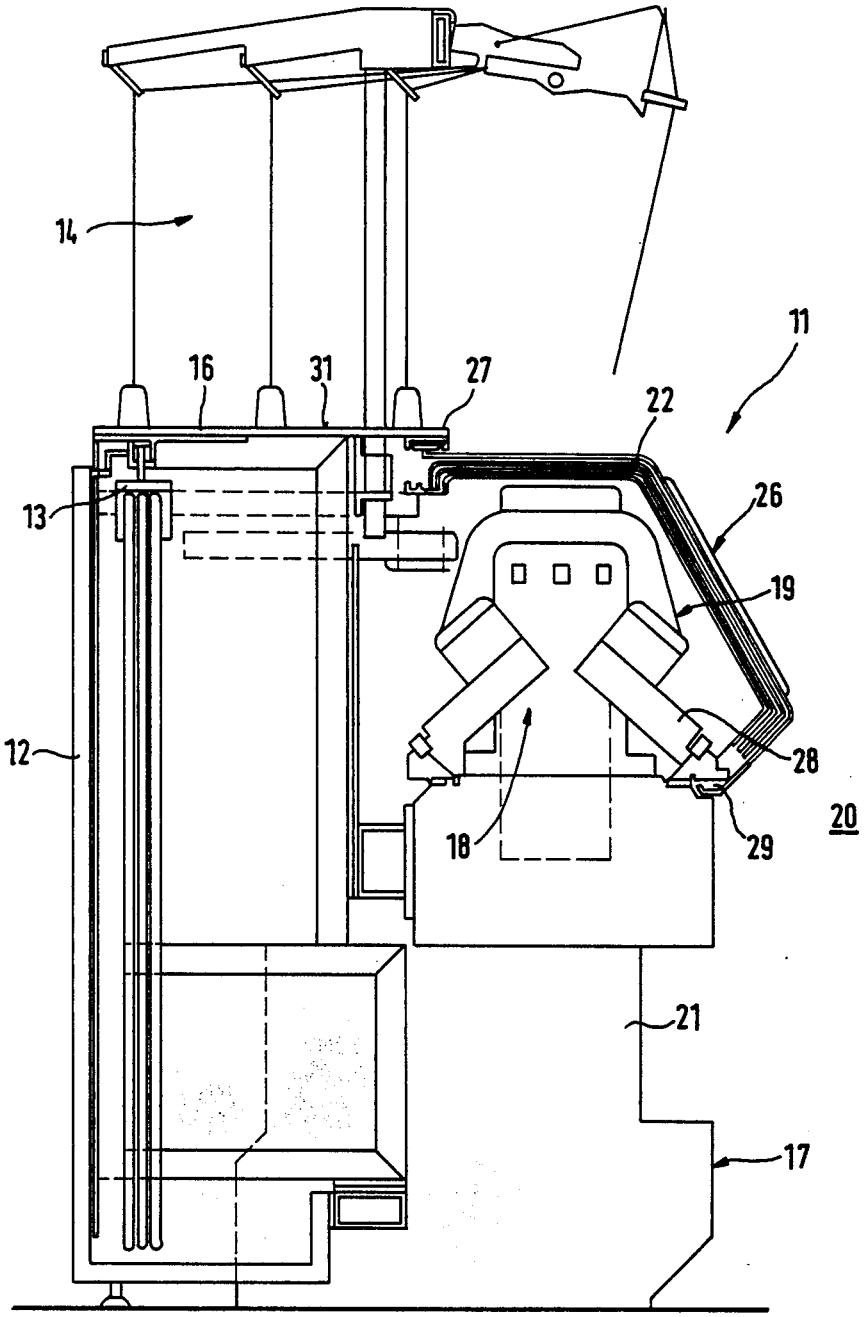
FIG. 1 is a schematic side view of a flat-bed knitting machine having an input keyboard according to an exemplary embodiment of the invention.

The flat-bed knitting machine 11 according to a preferred exemplary embodiment of the invention shown in FIG. 1 has a rear frame 12, on which a trailing power cable guide 13 is provided and on which a yarn supply apparatus 14 having a spool table 16 is secured, and a front, lower machine frame part 17, on which a V-like needle bed apparatus and a carriage apparatus 18, 19 disposed above it and sliding on it are retained. In a region 21 below the needle bed and carriage apparatus 18, 19, there is a data processing unit for controlling the flat bed knitting machine and for feeding in pattern information and the like and storing it in memory. At the level of the needle bed and carriage apparatus 18, 19 and covering both of them both at the top and in the front, that is, from the side 20 where the operator is located, a protective cover 22 is provided, which in the exemplary embodiment comprises three pairs of transparent hoods 23–25 that are displaceable in the longitudinal direction of the machine. In front of the protective cover 22 or the frontmost hood 25, as viewed from the standpoint of the operator side 20, there is an operating panel or input keyboard device 26. Both the protective cover 22 and the input keyboard device 26 extend from a front long edge 27 of the spool table 16 as far as a long side 29 extending underneath the front needle bed 28 of the needle bed apparatus 18. The protective cover 22 or its six hoods 23–25 are embodied such that they completely cover the needle bed and carriage apparatus 18, 19 over their entire longitudinal length whenever the hoods are moved beside one another. The input keyboard device 26 is movable over this entire longitudinal length.

Figure 2:
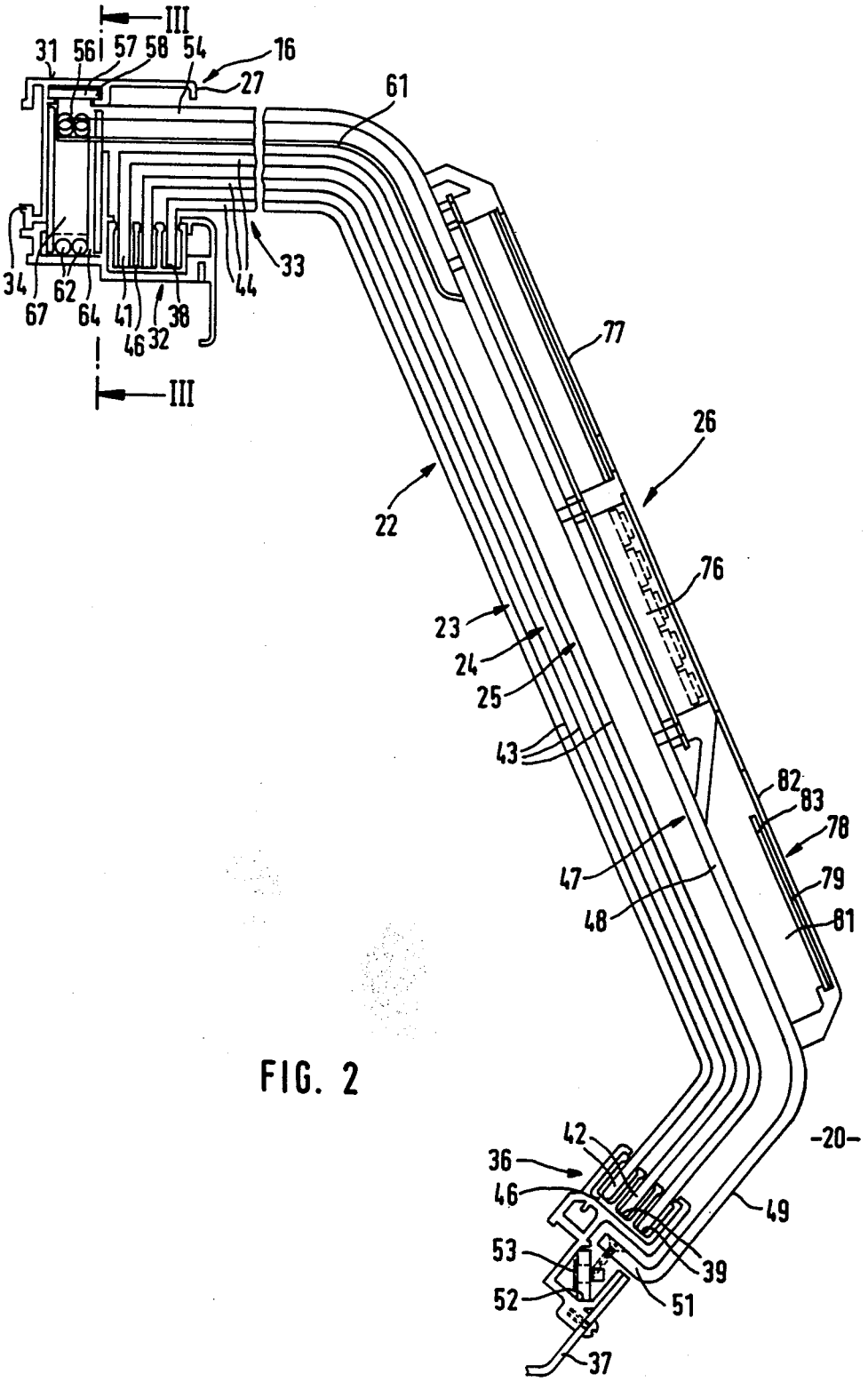
FIG. 2, on a larger scale is a side view of the input keyboard according to the present invention, disposed above a protective cover.

FIG. 2 in particular illustrates the movable disposition both of the hoods 23–25 of the protective cover 22 and of the input keyboard 26. The profiled front long edge region 27 of the spool table 16, together with a profile rail 32 disposed below the spool table surface 31 and extending over the same length, and being firmly connected to a support 34 of the spool table 16, forms an upper profile section 33 for movably or longitudinally displaceable reception of the hoods 23–25 and input keyboard device 26. In the vicinity of the long side 29, below the front needle bed 28, a lower profile rail 36 extending in the longitudinal direction of the machine is provided, which is secured to the front machine frame 17 with the aid of one or more holders 37 and serves to provide movable or longitudinally displaceable reception of the lower ends of the hoods 23–25 and input device 26.

An inner region of the upper profile rail 32 and of the lower profile rail 36, respectively, has three guide tracks 38 and 39 each, located beside one another, or behind one another as viewed from the operator side 20, in which the respective ends 41 of the hoods 23–25 can slide. The hoods 23–25 are arranged parallel to one another and such that they can be slid shut over one another, and are embodied such that they have one main region 43 that is inclined and located in front of the needle bed and carriage apparatus 18, 19; contiguous with this region 43 is an upper horizontal region 44, which merges with the end 41 extending downward vertically from it. On the bottom, the associated lower guided end region 42 adjoins the inclined main region 43 at an obtuse angle. The various completely transparent hoods 23–25 are preferably embodied as having equal width. The guide tracks 38, 39 are embodied by finger-like profile strips 46 made of a slidable plastic and received in the rails 32, 36.

Figure 5:
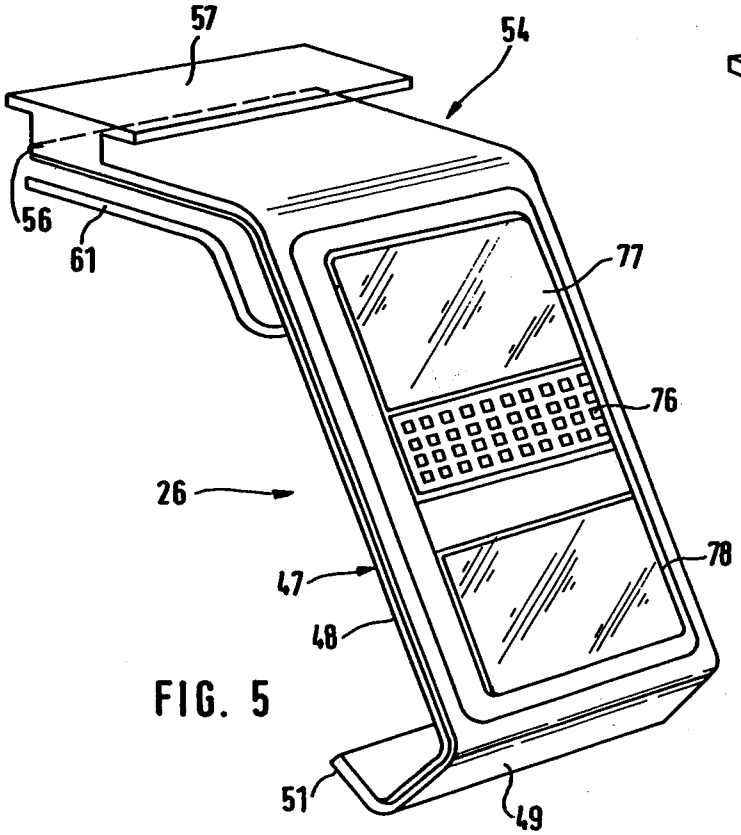
FIG. 5 is a schematic perspective view of the input keyboard of FIG. 2.

The input keyboard device 26, in the exemplary embodiment of FIGS. 1, 2 and 5, is disposed on a generally platformlike slide 47, on the inclined main region 48 thereof, which extends spaced apart from and parallel to the main regions 43 of the hoods 23–25 and is substantially narrower. The lower end of this inclined main region or middle platform region 48 merges at an obtuse angle with a lower support region 49, the end 51 of which, bent at an angle, engages a lower guide track 52 of the lower profile rail 36. The bent end 51 of the platform-like slide 47 is connected with one or two spaced-apart travel rollers 53, which are retained in the guide track 52 such that they are substantially immovable in the transverse direction but are movably guided in the longitudinal direction of the machine. Merging with the upper end of the middle platform region 48 is a horizontal region 54, the guided end 56 of which engages the upper profile section 33 and is provided with a T-shaped sliding block or sliding segment 57, which protrudes vertically upward from the end 56 and engages an upper guide track 58 embodied in the manner of an undercut groove, which is formed on the underside of the spool table 16. In this manner, the input keyboard device 26 is guided suspended in the upper profile section 33, while in the lower profile rail 36 it is guided resting or supported thereon. The input keyboard device 26 can be moved over the protective cover 22 over substantially the entire longitudinal length of the flat knitting machine 11, or of the needle bed and carriage apparatus 18, 19.

Below and parallel to the horizontal region 54 and partly below and parallel to the upper end of the middle platform region 48, an intermediate bottom 61 is provided over the width of the platform slide 47, the end of which likewise protrudes into the upper profile section 33. Control cables 62, for instance two in number, are placed on the intermediate bottom 61, leading from the input keyboard device 26 to the above-mentioned data processing unit and optionally to other elements as well. These control cables 62, of which more or fewer than two may also be provided, are introduced into the upper profile section 33, and at the end of the intermediate bottom 61 they are deflected by 90° via two elements 63 (see FIG. 4).

Figure 3:
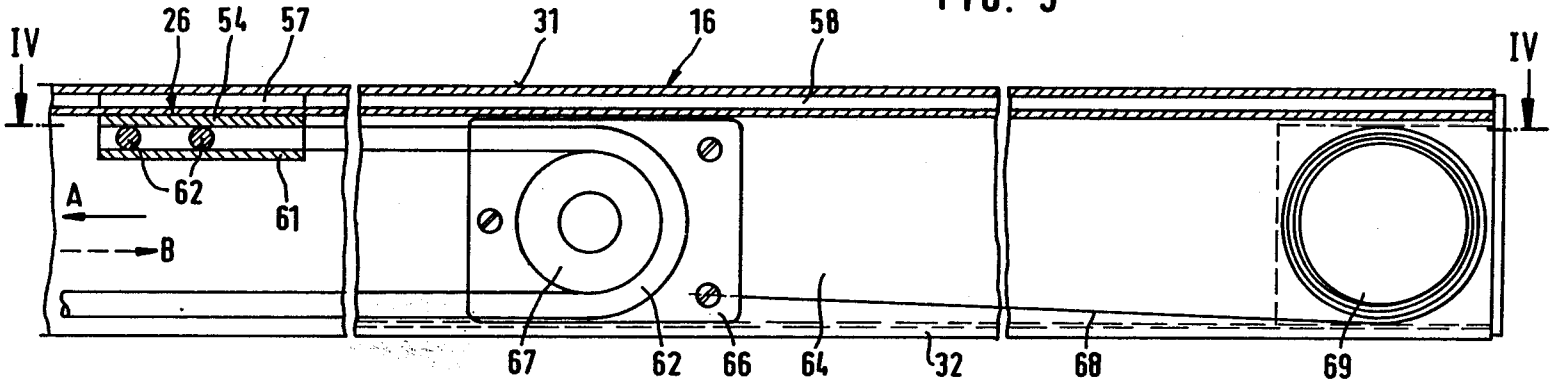
FIG. 3, on a larger scale, is a section taken along the line III—III of FIG. 2.
Figure 4:
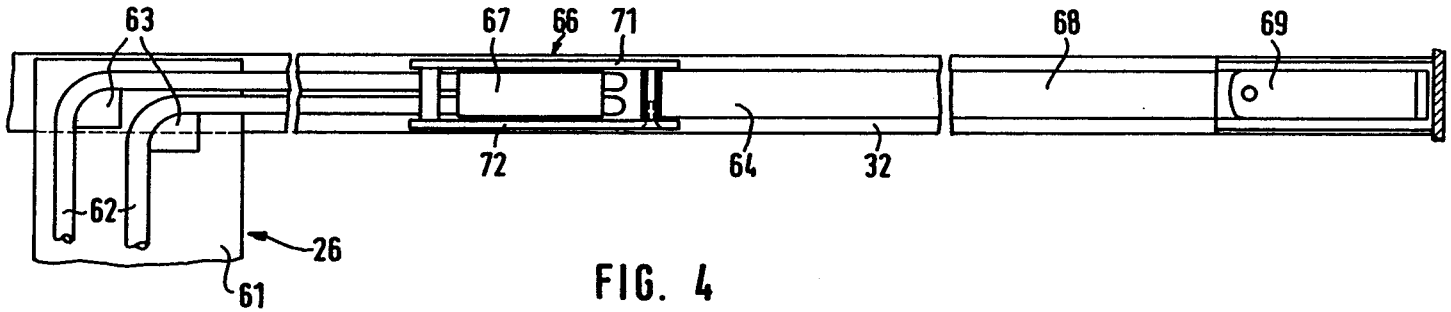
FIG. 4 is a plan view along the line IV—IV of FIG. 3.

As shown in FIGS. 3 and 4, a longitudinally movable or slidable carriage 66 is disposed or received in a holder space 64, extending longitudinally, of the upper profile section 33, between the spool table 16 and the upper profile rail 32; the carriage 66 supports a cable deflection roller 67. The control cables 62, disposed parallel beside one another, extend from the input keyboard device 26, or the intermediate bottom 61, to their deflection point 63 and to an upper region and in a parallel arrangement with respect to the deflection roller 67, and from there, after a 180° deflection into the region of the bottom of the holder space 64, to one end of the flat knitting machine 11, where they are kept wired fixedly to the data processing unit and optionally other elements as well. The carriage 66, at its end remote from the beginning and end of the control cables 62, is connected via a steel spring band 68 to a spring roller 69, and the spring roller or steel spring band 68 are pre-stressed such that the steel spring band 68 seeks to wind itself up onto the spring roller 69. The spring roller 69 is disposed stationary on the end of the holder space 64 remote from the stationary wiring location of the control cables 62. This means that whenever the input keyboard device 26 is moved in a direction indicated by the arrow A, the steel spring band 68 is rolled up counter to its spring action, because the carriage 66 is pulled along in the direction A as well, while in the opposite direction B, in which no tension is exerted upon the end of the control cable leading to the input keyboard device 26, the steel spring band 68 can again wind itself up, under the influence of its spring force, and thereby retracts the carriage 66. The carriage 66 is embodied by two sliding slide parts 71, 72, between which the deflection roller 67 is located, supported such that it can rotate.

As shown in FIGS. 2 and 5, the operating panel or input keyboard device 26 is provided with a keyboard area 76 in its middle, and above it a liquid-crystal display panel 77 and below it a holder 78, which has holder spaces 79, 81, for example two of them, the first of which being slit-like and formed by two parallel plates 82, 83 acting as braces, while the rear, larger holder space 81 is located behind the rear plate 83 and is accessible from above the holder slit 79.

Figure 6:
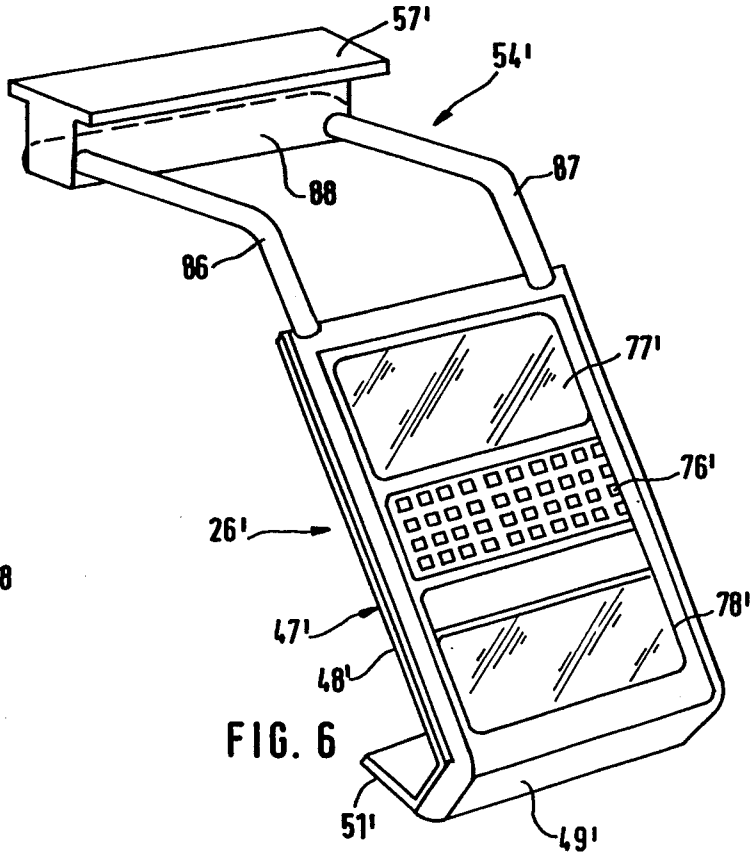
FIG. 6 is a schematic perspective view of a variant embodiment of the input keyboard.

FIG. 6 shows a variant of an operating panel or input keyboard device 26, which is likewise provided with a keyboard area 76', a display panel 77' and a holder 78' and which is secured on a slide 47, in which only part of the middle region 48' thereof and the lower support region 49' are platform-like in embodiment. The upper part of the middle region 48' and the horizontal region 54 are embodied by two parallel hollow bars 86, 87 bent an an obtuse angle. These bars 86, 87 are provided at their end engaging the upper profile section 3 with a crossbar 88 joining them, which carries the T-shaped sliding segment 57'. The control cables 62 are received in the hollow bars 86, 87 and in the vicinity of the crossbar 88 they are deflected via the deflecting roller 67 so as to be introduced into the holder space 64.

Both input keyboard devices 26, 26' are substantially narrower than each of the equally or unequally wide hoods 23≧25 of the protective cover 22. The pre-stressing effected by the spring assembly 68, 69 is constant and such that the input keyboard device 26, 26' can be positioned in any arbitrary position along the machine 11 and held there.

What is claimed is:

1. A flat-bed knitting machine, comprising:

a needle bed apparatus and associated carriage apparatus movable longitudinally on the machine;

cams and selector units; and a data processing unit for controlling the cams and selector units and for storing pattern information in memory, said data processing unit having an input keyboard dsposed at the level of and in the area in front of the needle bed apparatus and associated carriage apparatus, said keyboard being movable in the longitudinal direction of the machine to any position along the machine and independently of the needle bed apparatus and associated carriage apparatus.

2. The flat-bed knitting machine as defined in claim 1, further comprising:

a transparent protective cover movable in the longitudinal direction of the machine, wherein said input keyboard is pivotably secured on the transparent protective cover so that it can be pivoted upward thereby providing full view of the machine through the transparent protective cover.

3. The flat-bed knitting machine as defined in claim 1, further comprising:

a transparent protective cover movable in the longitudinal direction of the machine, wherein said input keyboard is movable in front of the transparent protective cover and parallel to and independently thereof.

4. The flat-bed knitting machine as defined in claim 3, wherein the protective cover has a plurality of hoods and a plurality of tracks for guiding the movement of the hoods and wherein said input keyboard is disposed in front of said hoods.

5. The flat-bed knitting machine as defined in claim 3, wherein the transparent protective cover includes a lower profile section defining a track, an upper profile section defining a track and an at least partly platform-like element having an upper end and a lower end said upper end being guided suspended in the track of the upper profile section and said lower end being guided resting in the track of the lower profile section, and wherein said input keyboard is secured to said at least partly platform-like element.

6. The flat-bed knitting machine as defined in claim 5, wherein said at least partly platform-like element has an upper horizontal region defining said upper end, a contiguous inclined region to which said input keyboard is secured, and a lower region continguous with said inclined region, but inclined in the opposite direction thereto, defining said lower end.

7. The flat-bed knitting machine as defined in claim 6, wherein at least below said upper horizontal region an intermediate bottom, embodied as a platform, is provided on which at least one control cable rests.

8. The flat-bed knitting machine as defined in claim 7, wherein the intermediate bottom extends within the upper profile section and is provided with at least one 90° deflection for the control cable.

9. The flat-bed knitting machine as defined in claim 6, wherein said upper horizontal region is embodied in the form of two parallel hollow bars, at least one of which receives at least one control cable.

10. The flat-bed knitting machine as defined in claim 9, wherein said upper horizontal region is further embodied to include a transverse element joining said hollow bars, said transverse element extending within the upper profile section and is provided with at least one 90° deflection for the control cable.

11. The flat-bed knitting machine as defined in claim 5, wherein the profile sections define movement tracks for the transparent protective cover.

12. The flat-bed knitting machine as defined in claim 1, further comprising:

a spring-loaded device for movement guided receiving of a control cable connected to said input keyboard in any position of said input keyboard in the longitudinal direction of the machine.

13. The flat-bed knitting machine as defined in claim 12, further comprising:

a spool table, and wherein the spool table includes a guide recess, and wherein the spring-loaded device includes at least one cable deflection roller movably guided longitudinally in said guide recess.

14. The flat-bed knitting machine as defined in claim 13, wherein the spring-loaded device includes a carriage to which the roller is secured, said carriage being movably guided longitudinally in said guide recess, and a stationary spring winder connected to the carriage and located on the far side of an end position of said input keyboard.

15. The flat-bed knitting machine as defined in claim 1, further comprising:

a transparent protective cover movable in the longitudinal direction of the machine, said input keyboard being movable in front of the transparent protective cover and parallel to and independently thereof;

a spool table including a guide recess; and a spring-loaded device for movement guided receiving of a control cable connection to said input keyboard in any position of said input keyboard in the longitudinal direction of the machine, wherein:

the transparent protective cover includes a lower profile section defining a track, an upper profile section defining a track and an at least partly platform-like element having an upper end and a lower end, said upper end being guided suspended in the track of the upper profile section and said lower end being guided resting in the track of the lower profile section, said input keyboard being secured to said at least partly platform-like element;

the spring-loaded device includes at least one cable deflection roller movably guided longitudinally in said guide recess, said guide recess being embodied in the upper profile section below the guide track defined thereby.

16. The flat-bed knitting machine as defined in claim 1, further comprising:

a spool table; and a transparent protective cover movable in the longitudinal direction of the machine, said input keyboard being movable in front of the transparent protective cover and parallel to and independently thereof, wherein:

the transparent protective cover includes a lower profile section defining a track, and upper profile section defining a track and an at least partly platform-like element having an upper end and a lower end, said upper end being guided suspended in the track of the upper profile section and said lower end being guided resting in the track of the lower profile section;

said input keyboard is secured to said at least partly platform-like element; and said upper profile section is embodied at least partly by the associated long side of the spool table.

17. The flat-bed knitting machine as defined in claim 1, further comprising:

a spool table;

a separate profile rod facing the underside of the spool table and connected to the spool table; and a transparent protective cover movable in the longitudinal direction of the machine, said input keyboard being movable in front of the transparent protective cover and parallel to and independently thereof, wherein:

the transparent protective cover includes a lower profile section defining a track, an upper profile section defining a track and an at least partly platform-like element having an upper end and a lower end, said upper end being guided suspended in the track of the upper profile section and said lower end being guided resting in the track of the lower profile section;

said input keyboard is secured to said at least partly platform-like element; and said upper profile section is embodied at least partly by the separate profile rail.

18. The flat-bed knitting machine as defined in claim 1, further comprising:

a spool table;

a profile rail secured to the machine underneath the needle bed apparatus; and a transparent protective cover movable in the longitudinal direction of the machine, said input keyboard being movable in front of the transparent protective cover and parallel to and independently thereof, wherein:

the transparent protective cover includes a lower profile section defining a track, an upper profile section defining a track and an at least partly platform-like element having an upper end and a lower end, said upper end being guided suspended in the track of the upper profile section and said lower end being guided resting in the track of the lower profile section;

said input keyboard being secured to said at least partly platform-like element; and said upper profile section is embodied at least partly by the separate profile rail.

19. The flat-bed knitting machine as defined in claim 1, wherein said input keyboard is provided with a display panel.

20. The flat-bed knitting machine as defined in claim 1, wherein said input keyboard is provided with a holder for documents.

21. The flat-bed knitting machine as defined in claim 1, wherein said input keyboard is provided with a recess for documents.

22. The flat-bed knitting machine as defined in claim 1, wherein said input keyboard is provided with a holder and a recess for documents.

23. A flat-bed knitting machine, comprising:

a needle bed apparatus and associated carriage apparatus movable longitudinally on the machine;

cams; and a data processing unit for controlling the cams and for storing pattern information in memory, said data processing unit having an input keyboard disposed at the level of and in the area in front of the needle bed apparatus and associated carriage apparatus, said keyboard being movable in the longitudinal direction of the machine to any position along the machine and independently of the needle bed apparatus and associated carriage apparatus.

24. A flat-bed knitting machine, comprising:

a needle bed apparatus and associated carriage apparatus movable longitudinally on the machine;

selector units; and a data processing unit for controlling the selector units and for storing pattern information in memory, said data processing unit having an input keyboard disposed at the level of and in the area in front of the needle bed apparatus and associated carriage apparatus, said keyboard being movable in the longitudinal direction of the machine to any position along the machine and independently of the needle bed apparatus and associated carriage apparatus.

* * * * *